US010189753B2

(12) United States Patent
Vandoninck

(10) Patent No.: US 10,189,753 B2
(45) Date of Patent: Jan. 29, 2019

(54) FOG-GENERATING DEVICE COMPRISING A REAGENT AND IGNITION MEANS

(71) Applicant: Bandit NV, Opglabbeek (BE)

(72) Inventor: Alfons Vandoninck, Opglabbeek (BE)

(73) Assignee: Bandit NV, Opglabbeek (BE)

( * ) Notice: Subject to any disclaimer, the term of this patent is extended or adjusted under 35 U.S.C. 154(b) by 405 days.

(21) Appl. No.: 14/652,550

(22) PCT Filed: Dec. 30, 2013

(86) PCT No.: PCT/EP2013/078112

§ 371 (c)(1),
(2) Date: Jun. 16, 2015

(87) PCT Pub. No.: WO2014/102365

PCT Pub. Date: Jul. 3, 2014

(65) Prior Publication Data

US 2015/0321970 A1 Nov. 12, 2015

(30) Foreign Application Priority Data

Dec. 31, 2012 (NL) ..... 1039983
Oct. 11, 2013 (EP) ..... 13188319

(51) Int. Cl.
*B05B 9/00* (2006.01)
*C06D 3/00* (2006.01)
(Continued)

(52) U.S. Cl.
CPC ..... *C06D 3/00* (2013.01); *A63J 5/025* (2013.01); *B05B 1/24* (2013.01); *B05B 7/166* (2013.01);
(Continued)

(58) Field of Classification Search
CPC ..... B05B 9/002; B05B 7/166; B05B 7/1666; B05B 1/24; B05B 11/02; B05B 11/0005;
(Continued)

(56) References Cited

U.S. PATENT DOCUMENTS 2,993,648 A * 7/1961 Blackwell ..... A01M 9/00 239/2.1
3,537,873 A * 11/1970 Degginger ..... A62D 1/0035 428/921
(Continued)

FOREIGN PATENT DOCUMENTS

DE 102006032504 1/2008
EP 0 726 550 A1 8/1996
(Continued)

OTHER PUBLICATIONS

International Search Report pertaining to Intl. Appln. No. PCT/EP2013/078112 filed Dec. 30, 2013.
(Continued)

*Primary Examiner* — Steven J Ganey
(74) *Attorney, Agent, or Firm* — Dinsmore & Shohl LLP

(57) ABSTRACT

The present invention relates to a fog-generating device comprising a reagent (1), ignition means (2), a reservoir (3) containing a fog-generating material (4), and a heat exchanger wherein gas generated by ignition of the reagent (1) drives fog-generating material from said reservoir to said heat exchanger. Further it relates to a removable housing for a fog-generating device comprising a reagent and a reservoir containing a fog-generating material, wherein in that said removable housing further comprises means to allow transmission of an ignition signal from said fog-generating device to said reagent. The invention further provides the use of said device and/or removable housing for the generation of fog, in particular to protect against intruders and physical treat by persons. In a particular embodiment, the
(Continued)

fog-generating device of the present invention or the removable housing therefore comprises depressurizing means (18). Depressurizing means allow the escape of gas from the device so that the pressure inside the device is reduced and becomes closer to atmospheric pressure.

20 Claims, 8 Drawing Sheets

(51) Int. Cl.

| | |
|---|---|
| ***B05B 1/24*** | (2006.01) |
| ***B05B 11/02*** | (2006.01) |
| ***B05B 11/00*** | (2006.01) |
| ***B05B 7/16*** | (2006.01) |
| ***A63J 5/02*** | (2006.01) |
| ***F41H 9/04*** | (2006.01) |
| ***G08B 15/02*** | (2006.01) |

(52) U.S. Cl.
CPC ..... *B05B 7/1666* (2013.01); *B05B 9/002* (2013.01); *B05B 11/0005* (2013.01); *B05B 11/02* (2013.01); *F41H 9/04* (2013.01); *G08B 15/02* (2013.01)

(58) Field of Classification Search
CPC . C06D 3/00; A63J 5/025; A01G 13/06; A01G 13/065
USPC ..... 239/2.1, 14.1, 128, 135, 136, 320–322, 239/329, 373; 169/9, 84, 85
See application file for complete search history.

(56) References Cited

U.S. PATENT DOCUMENTS

| | | | | |
|---|---|---|---|---|
| 5,803,359 | A * | 9/1998 | Vandoninck | G08B 15/02 239/136 |
| 5,984,016 | A * | 11/1999 | Samuelsson | A62C 35/023 169/9 |
| 6,087,935 | A | 7/2000 | Berner et al. | |
| 6,612,243 | B1 * | 9/2003 | Italiane | A62C 13/22 102/367 |
| 2010/0133354 | A1 * | 6/2010 | Vandoninck | F41H 9/06 239/14.1 |

FOREIGN PATENT DOCUMENTS

| | | | |
|---|---|---|---|
| EP | 1312888 | A1 | 5/2003 |
| EP | 2 259 004 | B1 | 1/2012 |
| GB | 2 269 749 | A | 8/1992 |
| WO | 03/001140 | A1 | 1/2003 |
| WO | 2008/132113 | A1 | 11/2008 |

OTHER PUBLICATIONS

International Preliminary Report on Patentability pertaining to Intl. Appln. No. PCT/EP2013/078112 filed Dec. 30, 2013.

* cited by examiner

FOG-GENERATING DEVICE COMPRISING A REAGENT AND IGNITION MEANS

FIELD OF THE INVENTION

The present invention relates to a fog-generating device comprising a reagent, ignition means, a reservoir containing a fog-generating material, and a heat exchanger wherein gas generated by ignition of the reagent drives fog-generating material from said reservoir to said heat exchanger. Further it relates to a removable housing for a fog-generating device comprising a reagent and a reservoir containing a fog-generating material, wherein in that said removable housing further comprises means to allow transmission of an ignition signal from said fog-generating device to said reagent. The invention further provides the use of said device and/or removable housing for the generation of fog, in particular to protect against intruders and/or physical treat by persons. It further provides the use of the removable housing in its different embodiments as described herein, in a fog-generating device. It also provides the use of a reservoir comprising a movable wall and a fog-generating material, again in the different embodiments described herein, in a fog-generating device.

BACKGROUND TO THE INVENTION

Fog-generating devices are used in several applications. They are used in entertainment for creating a specific mood or enhancing visual lighting effects. During the training of emergency and military personnel, they are used to simulate fire. In addition, they are used in security systems to disorient intruders and to hide valuables from them.

Typically, a fog-generating device creates fog by driving a fog-generating substance through a heat exchanger; upon which the fog-generating substance is converted into the vapour phase that is ejected at the exit [end] of the heat exchanger. Dependent upon the atmosphere in which said vapour is being ejected; the vapour may condense upon expansion into tiny liquid droplets suspended in the air as an aerosol, with the formation of a fog.

Thus as used herein "expel of fog" or similar terms by a fog-generating device, generally refers to the process wherein a fog-generating substance (hereinafter also referred to as a fog-generating material) is driven through a heat-exchanger, with the conversion of said fog-generating substance into the vapour phase that is ejected at the exit [end] of said heat exchanger.

Most often, a pump is used to drive fog-generating liquid from a reservoir to a heat exchanger. However, in said case, the time needed to convert all the fog-generating liquid to fog is dependent on the capacity of the pump, i.e. its ability to deliver a given flow within a given time at given pressure. Fog-generating device are often powered by standard voltage batteries, further restricting the capacity of such pumps. In addition, high-capacity liquid pumps would lead to too high product prices. Therefore, utilization of pumps to drive fog-generating liquids from the reservoir to the heat-exchanger seriously restricts the fog output of those fog-generating devices. WO2008132113 addresses this problem by using a pressure [compressed] vessel as a fog-generating liquid reservoir. When fog needs to be generated a normally closed valve (switch) between the pressure vessel and the connected heat exchanger is opened and, the pressure inside the vessel drives the fog-generating liquid from said vessel to the heat exchanger, thereby improving the capacity at which fog can be expelled from the device.

The capacity at which fog can be generated is of crucial importance when the device is used as a security device. For example, in the case of a burglary, the fog-generating device should fill the room with fog within a few seconds. In such case, valuables are immediately obscured from the sight of the intruder, and he will quickly try to escape by leaving the room. When fog is generated too slowly, the thief may use the additional seconds to quickly grasp valuables before leaving. The speed at which fog is generated by the device of WO2008132113 is dependent on the pressure in the vessel that contains the fog-generating liquid. While the pressure (P) and volume (V) that can be contained in the vessel is unlimited in theory, the legal framework on devices containing pressurized vessels restricts it's capacity. Above certain pressure thresholds and P×V, the laws make it impractical to build, transport, install and use such devices. Thus, although WO2008132113 presented a major improvement for security fog-generating devices, there is still a need for devices for faster fog generation, e.g. to more quickly fill a room with fog or to fill larger rooms with fog in the same time-frame.

It has been found that the fog-generators of the present invention solve the above-mentioned problems and allow a much faster generation of fog, due to the high entrance pressure that can be generated at the heat exchanger. Detailed analysis showed that prior art devices using a pump typically provide about 6 ml/s of fog-generating fluid to the heat exchanger at about 4-6 bar. Prior art devices which use a propellant gas to drive the fluid typically operate at about 28 ml/s at about 12-15 bar. Remarkably, a fog-generating device of the present invention comprising a removable housing with a pyrotechnic device have been found to be easily able to provide 60-80 ml/s of fluid to the heat exchanger at about 300-400 bar.

Prior art fog-generating devices for security purposes have another inherent risk. In contrast to fog-generating devices for entertainment, for military use and for training emergency personnel, fog-generating devices for security purposes need to be able to remain inactive for several years, without reducing their reliability. Indeed, it is very likely that a burglary/violent threat will only happen (if ever) several years after installment of the device. It has been found that prior art fog-generating devices comprising pumps become unreliable over time, apparently due to blockage, corrosion and/or chemical resistance problems or other failure of these pumps when they are not regularly used. Although the pump-less variant of WO2008132113 already presents an improvement in that regard, it is not possible to fully exclude that the switch that regulates the release of the fog-generating fluid from the pre-pressurized reservoir would become micro-leaking or defective. Thus, there is a need for fog-generating devices that have reliable means that are stable over time, even if not used regularly, to transport the fog-generating fluid from the reservoir to the heat exchanger. In particular, a fog-generating device without moving parts or pre-pressurization that could get stuck over time would be very beneficial.

Furthermore, prior art fog generators are often "one-shot" devices, which require that the device is refilled in situ by a skilled technician, or require that the device is sent to the manufacturer for refilling. Especially for security purposes, it is not wanted that the device can not function for a substantial period until a technician has refilled it or until a replacement device has been sent and installed. In addition, such a process is time-, resource- and cost-intensive.

Further problems often associated with the prior art devices are the limited degree of freedom for orienting the device. Although orientation of the exit from where the fog is blown is often crucial, e.g. for concealing particular parts of the room in first instance, prior art devices don't allow much freedom as in certain positions the fog-generating device will simply not work, or fog-generating liquid will spill out of the reservoir, thereby damaging the device or leaving insufficient liquid in the reservoir for proper functioning.

For example, U.S. Pat. No. 6,087,935 discloses a smoke screen device containing a pyrotechnic device. However, it is very restricted in its orientation and tilting the device would result in absence of smoke production. In addition, the device is a "one-shot" and would need complete replacement or cumbersome refilling in a factory. Furthermore, smoke production will only be initiated after smoke fluid has been heated by a further pyrotechnic device, thereby slowing down the start of smoke exiting.

EP0726550 provides a smoke generator wherein a coil is heated by combustion of a mixture. Similar to U.S. Pat. No. 6,087,935 this slows down the start of smoke production and the device of EP0726550 contains a valve that blocks smoke fluid from entering the coil until it has been heated enough. In FIG. 4, EP0726550 also provides collection of combustion gasses to thrust liquid substances in the coil. However, similar to U.S. Pat. No. 6,087,935, the smoke generator of EP0726550 can not be oriented in any direction and smoke fluid may flow out of the reservoir and wet the reagent. Furthermore, the device is a "one-shot" device requiring replacement of the whole device after it functioned.

Thus, there is a continued need for fog-generating devices that allow to fill a room more quickly with fog, as well as by leading to a quicker start of fog generation as by expelling higher volumes of fog per second. In addition, there is a need for devices that allow a larger degree of freedom for orienting the devices during transport and installation. Furthermore, there is a need for fog-generating devices that can be easily set-up and does not require a skilled technician to come on-site or sending the device to a facility for refilling the device with fog-generating material after the device has been initiated.

It has been found that the fog-generating device and the removable housing of the present invention provide a solution to the above-mentioned problems.

SUMMARY OF THE INVENTION

Viewed from a first aspect, the present invention provides a fog-generating device comprising a reagent (1), ignition means (2), a reservoir (3) containing a fog-generating material (4), and a heat exchanger (5) characterized in that gas generated by ignition of the reagent drives fog-generating material from said reservoir to said heat exchanger. In a particular embodiment, the fog-generating device further comprises a movable wall (8), wherein gas generated by ignition of the reagent drives said movable wall to expel fog-generating material from said reservoir to said heat exchanger. In another particular embodiment, the present invention provides a removable housing for removably connecting to a fog-generating device that comprises a heat exchanger, said removable housing comprising at least a reservoir (3) containing a fog-generating material (4). In a particular embodiment said removable housing comprises a reagent (1) and a reservoir (3) containing a fog-generating material (4).

As used herein "reagent" generally refers to a chemical that in a chain reaction with an oxidizer is capable to convert the chemical energy present within said chemical into an energetic gas generation. In a preferred embodiment, the reagent comprises a fuel and an oxidizer; in particular the reagent is a fast conflagrating material, such as a nitrocellulose-based material. Non-limiting examples of suitable reagents are single-based propellants and their composites, such as solid rocket fuel (sugars, polymers (PBAN and carboxyl and hydroxyl)), specific carbohydrates, nitroguanidine, sodium azide (NaN) and metal powders and oxides (aluminium powder and iron oxide, catocine and ferrocene). Preferentially, single-based propellants with a low toxicity or irritation are used, certainly if the generated gas is expelled together with the fog from the fog-generating machine, for example propellants frequently used in airbags. These include Low vulnerability (LOVA) propellants (such as RDX, nitrocellulose, CAB and inert or energetic plasticizers) and FOX-based propellants. In addition, double based propellants consisting of nitrocellulose and nitroglycerin, and triple based propellants consisting of nitrocellulose, nitroguanidine and nitroglycerin or other liquid organic nitrate explosives may be used. It is also an object of the present invention to provide the use of said reagent in a fog-generating device, in particular in a fog-generating device comprising a heat exchanger.

As used herein "ignition means" or "Ignition system" generally refers to the element or elements that in combination provide the energy needed to start the chain reaction to convert the chemical energy present within the reagent into a gas (energetic gas generation). As detailed further herein below, any ignition means can be used and the skilled person is well aware of how to choose ignition means based on the reagent that is used.

As used herein "a fog generating material" or "a fog generating substance" generally refers to any material or combinations of materials, that can be vaporized when fed through a heat exchanger. When exiting the heat exchanger into the atmospheric pressure and normal ambient temperature and additional coming into contact with the moisture and dust particles [in the outside air] the vapour condenses into tiny liquid droplets suspended in the air as an aerosol, with the formation of a visible fog. In a preferred embodiment, the fog-generating material is a gel or a liquid, in particular a liquid, more in particular a polyol-containing liquid or gel. In a further aspect it is the object of the present invention to provide the use of the reagent (supra) and a reservoir comprising a fog-generating material in a fog-generating device, wherein the use of said reagent upon ignition provides a gas to drive the fog-generating material into the heat exchanger present within said fog-generating device.

It has been found that the energy from the gas that is generated by the ignition of the reagent can be used in several different manners to drive the fog-generating material from the reservoir to the heat exchanger. In a particular example, the gas enters the reservoir and thereby expels the fog-generating material contained therein. In another example, the gas is used to power a pump or turbine that drives the fog-generating material from the reservoir to the heat exchanger. The generated gas may be hot, causing thermal damage to components of the fog-generating material. Therefore, in a particular embodiment, the fog-generating device comprises cooling means (6) to cool the gas before it contacts the fog-generating material.

In another preferred embodiment, the fog-generating device of the present invention further comprises means (10 and 11, or 7 and 13) that separate the fog-generating material from the reagent. Such separation means prevent undesired contact between the fog-generating material the reagent and ignition means, e.g. due to movement or transport of the device. In particular when the fog-generating material is a liquid, separation means prevent wetting of the reagent and the ignition means. In one embodiment said separation means may be constructed so that they fully or partially disintegrate upon gas generation. As for example shown in FIG. 3, the reagent (1) could be confined in a housing (10) having a pressure and/or temperature sensitive closure (11). Upon ignition of the reagent and subsequent gas formation pressure and/or temperature will increase within said housing. Under influence of said pressure and/or temperature the pressure and/or temperature sensitive closure (11) will disintegrate releasing the generated gas into reservoir (3) containing the fog-generating material (4). In another embodiment, such as for example shown in FIG. 5, the separation means are movable and remain intact during and after gas generation. In such instance, movement of the separation means may lead to expelling fog-generating material from the reservoir. It is accordingly an object of the present invention to provide the use of a reservoir comprising separation means, in particular movable separation means, and a fog-generating material in a fog-generating device. In particular in a fog-generating device comprising a heat-exchanger.

More reagent can be added than is strictly necessary to drive the fog-generating fluid from the reservoir to the heat exchanger. Given that only minor amounts of reagent as described herein are needed to generate large volumes of gas, the effects of such an addition to the construction and cost of the device are negligible. However, it has been found that the extra energy produced by the gas generation can be used for several additional beneficial effects.

For example, larger volumes of gas may be mixed and dissolved into the fog-generating material before it enters the heat exchanger. Once inside the heat exchanger, this dissolved gas expands with the generation of gas bubbles, leading to higher turbulence of fog generating material. As such, with the amount of gas dissolved in the fog generating material, there is a better contact between the fog-generating material and the heat exchanger, which increases the efficiency of fog generation, and augments the energy content of expelled fog.

The higher energy of the expelled fog due to the additional generated gas can also be used to entrain ambient air into the expelled fog. Therefore, in another embodiment, the fog-generating device may further comprise means, such as a steam ejector, to entrain ambient air in the generated fog. The entrained ambient air has been found to result in a better dissipation of the fog into the surroundings.

Furthermore, inclusion of a higher amount of reagent than is necessary for driving the fog-generating material from the reservoir to the heat exchanger has been found useful for purging the heat exchanger after fog generating material has been expelled. Excess gas thus generated can either be used directly or indirectly to purge the heat exchanger after fog generating material has been expelled. When used directly, the excess gas is allowed to flow through the heat exchanger and removes non-ejected vapour out of the heat exchanger into the ambient air. When used indirectly, the excess gas can be used to entrain ambient air into the heat exchanger to purge non-ejected vapour out of the heat exchanger.

In a further aspect, the present invention provides a removable housing for a fog-generating device, comprising a reagent as defined herein and a reservoir containing a fog-generating material, wherein said removable housing further comprises ignition means or elements thereof, to allow transmission of an ignition signal from said fog-generating device to said reagent. In other words, and as will become clear from the detailed description herein below, such a "removable housing" or "cartridge" comprises the consumables used in the expel of fog by the fog-generating device according to the present invention. It is accordingly an object of the present invention to provide the use of such a removable housing in a fog-generating device, in particular in a fog-generating device comprising a heat exchanger.

Furthermore, the present invention provides the use of a fog-generating machine as described herein, or a removable housing as described herein, for generating fog. In particular, for protecting against burglars and intruders. In addition, the present invention provides a method for generating fog, said method comprising:

a) generating gas by igniting reagent(s);
b) using said gas to drive a fog-generating material from a reservoir to a heat exchanger; and
c) generating fog by heating said fog-generating material in said heat exchanger.

BRIEF DESCRIPTION OF THE DRAWINGS

With specific reference now to the figures, it is stressed that the particulars shown are by way of example and for purposes of illustrative discussion of the different embodiments of the present invention only. They are presented in the cause of providing what is believed to be the most useful and readily description of the principles and conceptual aspects of the invention. In this regard no attempt is made to show structural details of the invention in more detail than is necessary for a fundamental understanding of the invention. The description taken with the drawings making apparent to those skilled in the art how the several forms of the invention may be embodied in practice.

DETAILED DESCRIPTION OF THE INVENTION

Figure 1:
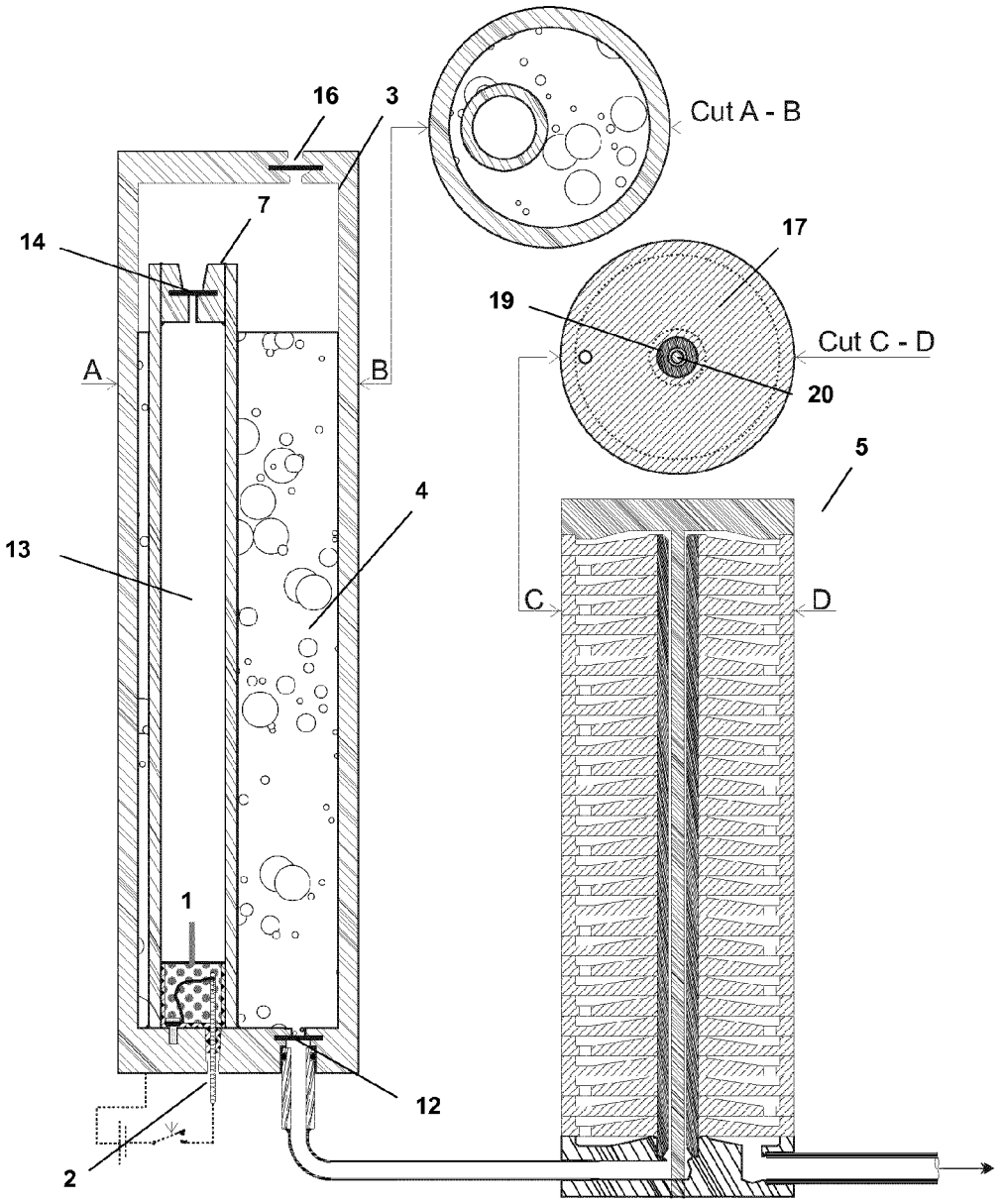
FIG. 1: Schematic drawing of a fog-generating device according to the present invention.

As discussed herein before, it has been found that the problems associated with the fog-generating devices of the prior art can be solved by the generation of a fog-generating device that comprises a reagent, ignition means, a reservoir containing a fog-generating material, and a heat exchanger characterized in that gas generated by ignition of the reagent drives fog-generating material from said reservoir to said heat exchanger. In a particular embodiment, said fog-generating device further comprises a movable wall and wherein gas generated by ignition of the reagent drives said movable wall to expel fog-generating material from said reservoir to said heat exchanger. In another particular embodiment, the present invention provides a removable housing for removably connecting to a fog-generating device that comprises a heat exchanger, said removable housing comprising at least a reservoir (3) containing a fog-generating material (4); in particular comprising a reagent (1) and a reservoir (3) containing a fog-generating material (4). It is accordingly an object of the present invention top provide the use of each and all of the elements mentioned above, in a fog-generating device, in particular in a fog-generating device comprising a heat exchanger.

As already mentioned herein before "reagent" as used herein, generally refers to a chemical that in a chain reaction with an oxidizer is capable to convert the chemical energy present within said chemical into a gas. In principle, any chemical can be used that in reaction with an oxidizer is converted into a gas. In a preferred embodiment, said reagent comprises a fuel and an oxidizer; more in particular said reagent is an fast conflagrating, also known as a deflagrating material, i.e. referring to a material capable of a rapid an high energy release by means of a subsonic combustion that propagates through thermal conductivity wherein hot burning material heats the next layer of cold material and ignites it. As the reagent comprises an oxidizer, there is no need to add an external oxidizer. Thus, the fog-generator of the present invention can be constructed as a closed system that does not need any external input besides ignition energy. After ignition, a chain reaction starts wherein reagent that is ignited is combusted/decomposed to form gas and it's combustions provides the energy needed to ignite nearby remaining reagent. In a particular embodiment, the reagent is an explosive material. In a further embodiment, the reagent is a pyrotechnic reagent. The skilled person is able to select any of the known fast conflagrating/deflagrating materials. In a preferred embodiment, the reagent is a so-called low or slow explosive. It has been found that these types of explosives release sufficient gas at a sufficiently fast rate. Per reference to the exemplified embodiments, the reagent may be present within the reservoir (3) comprising the fog-generating material (4). It is accordingly an object of the present invention to provide a fog-generating device comprising a reagent (1), ignition means (2), a reservoir (3) containing a fog-generating material (4), and a heat exchanger (5) characterized in that gas generated by ignition of the reagent drives fog-generating material from said reservoir to said heat exchanger; and in that said reagent is present within the reservoir containing the fog-generating material. The use of such reservoir in a fog-generating device is also an object of the present invention.

Any ignition means can be used. The skilled person is well aware of how to choose ignition means based on the reagent that is used. Such as by providing direct heat, e.g. a glow unit, or as non-limiting examples, metal-oxidizers (zirconium-potassium perchlorate, boron-potassium perchlorate, . . . ), metal hydride-oxidizers (zirconium hydride-potassium perchlorate, . . . ), intermetallics (titanium-boron, nickel-aluminium, palladium-aluminium, . . . ) can be used. In a particular embodiment, an intermetallic composition is used, in particular Palladium-clad aluminium, also known as Pyrofuze. The above types of ignition means are particularly useful since they are stable and only require the flow of an electrical current for ignition. Nonetheless, other ignition means can be used as well, e.g. blasting caps, detonators, and other systems based on shock wave and/or heat production. In general an ignition system comprises a part that transfers energy to the reagent, an ignition switch and an ignition energy source. In particular the fog-generating device of the present invention comprises a part that transfers energy from an ignition energy source to the reagent. While the ignition energy source and ignition switch may be located outside of the fog-generating device, it is preferably located inside the fog-generating device. As a non-limiting example, the ignition energy source may comprise a capacitor, which stores electrical energy. After an ignition switch is switched on, energy from the capacitor is allowed to flow through the igniter. As a result, the needed ignition energy is transferred to the reagent, thereby igniting the reagent and starting the gas generation.

In a particular embodiment, the fuel is not a hydrocarbon, such as diesel fuel, gasoline or kerosene. In a further embodiment, the fuel is not a liquid fuel, more in particular the fuel is a solid fuel. As described herein before, the reagent may comprise a fuel and an oxidizer. The fuel and oxidizer may be part of the same molecule, or it may be a mixture of the two (separate) components. For example, nitrocellulose consists of molecules that contain an oxidizer (nitrate ester groups) as well as a fuel (cellulose). Examples of oxidizers that may be added include 5-aminotetrazole nitrate, $KNO_3$, potassium oxides and ammonium perchlorate.

Other additives may be added as well. These may aid in improving (lowering/increasing) the combustion speed, the produced heat and/or the gas production. Examples include metals and their oxides, ferrocene and katocene, and retardants (e.g. carbonates, nitrates and/or oxylates). The speed of gas production may also be manipulated by coating reagent particles with relatively inert materials. The thickness of the coatings as well as the size of the particles will influence the amount of retardation.

In a particular embodiment, the fog-generating device of the invention further comprises separation means (7) that separate the fog-generating material from the reagent and ignition. In a particular embodiment, and as further detailed hereinafter, the separation means correspond to the reagent holding means (25), and prevent that reagent is distributed freely in the remainder of the housing comprising the reagent, and in particular in the optional combustion chamber, before ignition. Beneficially, they allow the reagent to be pressed slightly, so that there is a good contact between all the reagent material to ensure that the initiated chain reaction of the reagent is completed over the full mass of the reagent. These separation means further prevent undesired contact of the fog-generating material with the reagent and ignition, for example during transport and installation of the device. In a particular further embodiment, these separation means may at least partially disintegrate upon gas generation (7). Said separation means may close off an initially sealed combustion chamber (13) and/or housing (10). Hereinafter said housing is also referred to as the container comprising the reagent. It has been found by the inventors that combustion in an initially sealed combustion chamber and/or housing comprising the reagent, improves the efficiency of reagent combustion, likely due to the higher temperature and pressure inside the chamber and/or housing during gas generation. The chamber is preferentially sealed with separations means that may at least partially disintegrate upon gas generation, such as a pressure-sensitive seal (11) or (14).

Only after a certain amount of gas has been produced, and, hence, a certain amount of pressure has been built up in the chamber, the combustion chamber is unsealed and the gas is released. Such a pressure-sensitive seal may comprise a burst disc that is ruptured upon high pressure, or a pressure valve. It is evident that such pressure-sensitive seal may be comprised in the above-described separation means. In such embodiment, upon gas generation in the combustion chamber, the pressure-sensitive seal is ruptured, thereby at least partially disintegrating the separation means. As a result, generated gas is released from the combustion chamber and can be used to drive the fog-generating material from the reservoir to the heat exchanger. In addition to a pressure-sensitive seal, as is known by the skilled person, other separation means can be used that will disintegrate upon gas generation. E.g. seals that will melt above a certain temperature (e.g. aluminium- or zinc-based seals), seals that dissolve upon gas production (e.g. lithium-based seals), or combinations of any of the before-mentioned means. In a preferred embodiment, the separation means consist of a non-permeable material in that it should prevent moisture or propellant gas from entering the combustion chamber (13) and/or housing (10) comprising the reagent. Such non-permeable material may for example be a metallic or metallic coated material. In an alternative embodiment such separation means consist of pressure and/or temperature activated/controlled valves. In a particular embodiment the container comprising the reagent is present within the reservoir comprising the fog-generating material, optionally as part of an initially sealed combustion chamber. Ignition of the reagent may be realized using the above mentioned ignition means wherein some or all elements of said ignition means may eventually be present within the container that holds the reagent. In one embodiment at least the part of the ignition means that transfers the ignition energy to the reagent is present within the container that holds the reagent.

As described herein before, the container that holds reagent and the ignition means may be present within the reservoir of the fog-generating material, or it may be located outside of it. In a particular embodiment, the reagent and the ignition means are comprised in the container that holds the reagent, wherein said container is located in the reservoir comprising the fog-generating material. Preferably the ignition means contact the reagent and transfer the energy needed to ignite the reagent. Other components needed to initiate the ignition, such as an ignition controller and an ignition energy source may be located outside of the container, outside of the reservoir comprising the fog-generating material, and even outside of the fog-generating device of the present invention (See FIG. 1). The reagent and all of the components needed to control its ignition, can generally be referred to as a pyrotechnic device. In the embodiment wherein the fog-generating device comprises a removable housing, said pyrotechnic device may be present within said removable housing. For example, an external surveillance system may send an alarm signal to the fog-generating device, upon which a switch is controlled in the fog-generating device which closes a circuit containing the ignition energy source (e.g. a capacitor or supercapacitor) and the ignition means, thereby igniting the reagent.

Evidently, multiple combustion chambers may be used in parallel or in series direct or via a one-way valve. E.g. one combustion chamber may be used to generate gas for driving a fog-generating liquid to a heat exchanger, while another combustion chamber may be used for a different purpose, e.g. to purge the heat exchanger after fog production (see also further below). Two combustion chambers may also be used, wherein gas generated by both chambers is used to drive the fog-generating material to the heat exchanger. Multiple combustion chambers may also be connected to multiple reservoirs. In this instance, the fog-generating material from these reservoirs may be used at the same time or one after another. Furthermore, the fog-generating device of the invention can be constructed so that after a first reservoir has been emptied, there is still fog-generating material in a second reservoir that can be used to generate fog only after another ignition signal is received. This way, the fog-generating device can be used multiple times when the emptied reservoirs have not directly been replaced. In a particular embodiment, when using multiple pyrotechnic devices each may be located in a separate removable housing. In an alternative embodiment, the removable housing of the present invention may contain two or more pyrotechnic devices.

In a particular embodiment, said fog-generating device further comprises a movable wall (8), in particular said movable wall is present within the reservoir comprising the fog-generating material. Gas generated by ignition of the reagent can drive said movable wall to expel fog-generating material from said reservoir to said heat exchanger. Due to the movable wall, the fog-generator and/or removable housing can be held in any orientation without fluid contacting the reagent and/or ignition. Furthermore, independent of the orientation, the movable wall will be driven by generated gas to expel the fog-generating material from the reservoir since the fog-generating material will always be in contact with and flow to the exit of the reservoir. This allows for a complete degree of freedom when positioning the fog-generating device, which is often crucial to direct generated fog towards valuables or the expected entry of intruders. As an added benefit, the movable wall prevents contact between generated gas and fog-generating material, which may be beneficial if toxic or irritant gasses are produced after ignition of the reagent, or if these gasses are too hot, thereby negatively influencing the fog-generating material. In this instance the separation means prevent generated gas from contacting the fog-generating material and, thus, from being expelled together with the generated fog. More in particular, the separation means can slidably move to drive the fog-generating liquid from the reservoir to the heat exchanger. As an example, the separation means may be a movable, slidable wall within the reservoir, such as a piston. When gas is generated at one side of this wall, the wall moves to expel the fog-generating material situated on the other side of the wall from the reservoir towards the heat exchanger. In another embodiment, the movable wall can move elastically. For example, the fog-generating material may be present in or around a compressible packaging, such as an elastic bag. The compressible/expandable packaging itself may be located in a housing. When generated gas enters the housing, the compressible packaging is compressed or expanded, thereby moving the wall of the packaging and expelling the fog-generating material from the reservoir. It is thus an object of the present invention to provide the use of such a reservoir or housing comprising a movable wall or separation means (supra) in a fog-generating device, in particular in a fog-generating device comprising a heat exchanger.

It has also been found by the inventors that the presence of a movable wall in a reservoir containing fog-generating liquid may be beneficial for fog-generating devices wherein said movable wall is driven by other means than gas generated from a reagent. For example, a movable wall in a reservoir containing fog-generating material may be driven by a compressed propellant gas. Said compressed propellant gas may be present in a separate vessel, or it may be present in the same reservoir containing the fog-generating liquid. Therefore, in a particular embodiment, the present invention provides a fog-generating device comprising (a) a reservoir comprising a movable wall and a fog-generating material, and (b) means to drive said movable wall to expel said fog-generating material from said reservoir. In a particular further embodiment, said means to drive said movable wall comprise a propellant gas. Suitable propellant gases include liquefied propellant gases, such as partly halogenated hydrocarbons, or compressed propellant gases, such as an inert gas (e.g. nitrogen), noble gas (e.g. helium, neon or argon), compressed air or $CO_2$, or mixtures thereof. In a particular embodiment, said means to drive said movable wall to expel said fog-generating material from said reservoir are located in a vessel outside of said reservoir. In another particular embodiment, the present invention provides a fog-generating device comprising a reservoir comprising a movable wall having a first and a second side, wherein said reservoir further comprises a fog-generating material on said first side of the movable wall and means to drive said movable wall on said second side of the movable wall. Said reservoir further comprises an exit through which the fog-generating material can be expelled from the reservoir. Liquid connection means connect the exit of the reservoir to the heat exchanger. The fog-generating device further comprises a flow controller. In inactive form, the flow controller prevents that fog-generating material is expelled from the reservoir. Various types of flow controllers are known to the skilled person and suitable for the fog-generating device of the present invention. For example, a valve can be used to block outflow of fog-generating material from the exit, such as the closing means (12) as described herein. Such a valve may be a valve which can be switched between an on-off position, or it may be a valve that can be activated non-reversibly (such as a bursting disc that is at least partially destroyed when activated). In particular, said valve is activated mechanically or chemically, such as by intermetallic and/or pyrotechnic reactions. If the means to drive the movable wall are located outside of the reservoir containing the fog-generating material, the flow controller can be located between said means and said reservoir. For example, a valve may be used to block outflow of a compressed gas from a vessel to the reservoir. Once the valve is activated, compressed gas enters the reservoir and drives the movable wall, thereby expelling the fog-generating material from the reservoir to the heat exchanger. Said flow controller may also be connected to the movable wall. Such a flow controller blocks movement of the movable wall. Upon activation of the flow controller, e.g. breakage of the connection to the movable wall, the movable wall is driven by means to drive the movable wall, e.g. a compressed gas located outside or inside the reservoir. The present invention further provides a removable housing for a fog-generating device comprising a reservoir comprising (a) a movable wall and (b) a fog-generating material. Said movable wall is constructed such that its movement expels the fog-generating material from the reservoir. Evidently, other features in relation to the reservoir, removable housing, fog-generating device, fog-generating liquid, etcetera described in this application for the other embodiments are also applicable to the embodiments described in this paragraph. The presence of the movable wall in the reservoir containing the fog-generating material allow the fog-generating device to be oriented in any position, as the movable wall assures that the fog-generating material is always located at the exit of the reservoir and can be expelled towards said exit in any position of the device. It is also an object of the present invention to provide the use of such reservoir comprising a movable wall and a fog-generating material in a fog-generating device, in particular in a fog-generating device comprising a heat exchanger.

In another embodiment, the fog-generating device of the present invention comprises a pump. Energy from the gas generation can be used to power said pump, which in turn drives the fog-generating material from the reservoir to the heat exchanger.

As is evident from the above in either embodiment the energy liberated from the reagent in the formation of the gas is used to drive the fog generating material, with in particular fog-generating fluid from a reservoir to a heat exchanger. Either the energy from the gas generation is used directly because it enters the reservoir and thereby expels the fog-generating material, or it is used indirectly, e.g. to power a pump or turbine. In a preferred embodiment, said gas enters said reservoir to drive said fog-generating material from said reservoir to said heat exchanger. As described before, gas entering the reservoir may contact the fog-generating material, or may be separated from the fog-generating material by separation means. To prevent a potentially negative effect of hot gas on components of the fog-generating material (e.g. glycol), in a particular embodiment, the fog-generating device of the present invention further comprises cooling means to cool said gas before it contacts said fog-generating material. Any cooling means can be used, e.g. a cooling channel that passes through the fog-generating material. Fog-generating material surrounding the cooling channel is heated, while gas running through the channel is cooled. Beneficially, in such way, fog-generated material is preheated before it contacts the heat exchanger, thereby requiring less energy from the heat exchanger to convert the fog-generating material into vapour.

In a preferred embodiment, the reservoir containing the fog-generating material is initially closed. This prevents that fog-generating material is released from the reservoir before it is needed. The closing means (12) may be as the sealing means described for the combustion chamber. In a particular embodiment, the closing means are pressure sensitive. After gas generating leads a pressure in the reservoir above a certain threshold, the closing means open, thereby starting a flow of fog liquid to the heat exchanger. Thus opening of the closing means places the reservoir in fluid communication with the heat exchanger and this will lead to fog-generating material being driven from the reservoir to the heat exchanger. Evidently, other closing means can be used as well, e.g. a valve that may be opened mechanically. Closing means may be opened at the same time of the ignition, or only after a certain time or pressure or temperature, etcetera. In case said closing means would hamper, further security means (16) may be incorporated in the housing of the reservoir comprising the fog-generating material. In its simplest form and as exemplified in FIG. 1, such further security means could consist of a pressure sensitive seal such as a bursting disc or security valve.

Figure 2:
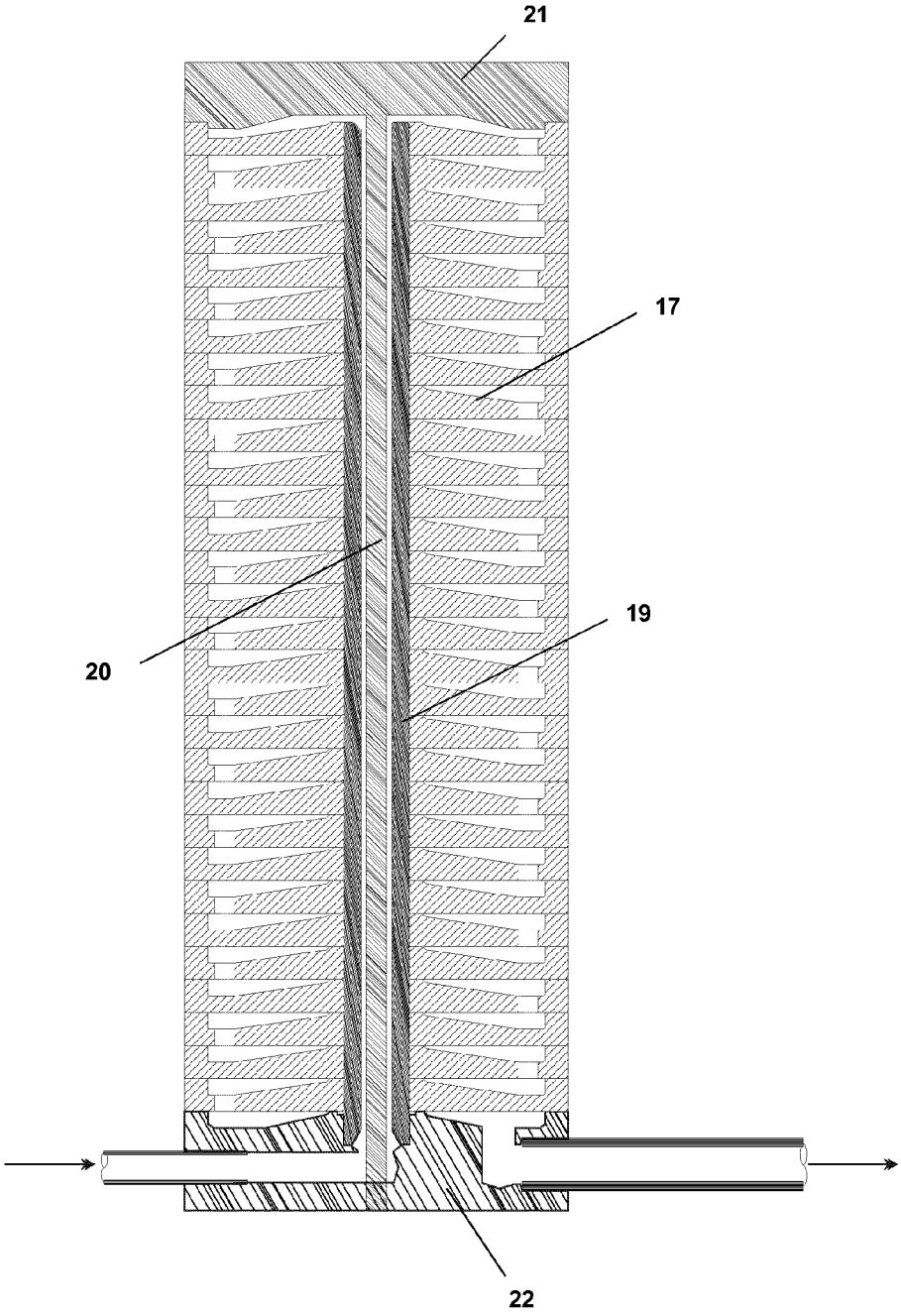
FIG. 2: Schematic cross-sectional drawing of a heat-exchanger suitable for use in a fog-generating device according to the present invention.

The fog-generating device according to the present invention will preferably be used for security applications; it should therefore be able to deliver a very high amount of ejected fog per second. Knowing that about 1 ml of fog-generating fluid is sufficient to obscure about 1 $m^3$ and that about 1000 Joules, is needed to convert the fog-generating fluid into fog, the heat exchanger should be able to deliver at least 25 kJ/s, and preferably about 100 kJ/s. Given the speed with which the liquid is to be converted in vapor [steam], one cannot solely rely on the thermal conductivity of the heat exchanger used. Consequently, the heat-exchanger to be used in the fog-generating device according to the present invention should have a high heat capacity (C), such as for example by using steel (±0.46 J/° C. per g) or copper, eventually combined with a latent heat of fusion accumulator; and a high heat transfer by a high contact surface between the fog-generating fluid and the heat exchanger. The latter may for example be realized using the labyrinth design with stacked plates (17) as shown in FIG. 2. Such labyrinth design allows rapid heat transfer but also creates a relatively large dynamic resistance. A pressure drop between input and output of a 50 bar at a flow rate of 100 ml/s is, therefore, not to be ruled out. However, with the high pressure generated in the reservoir containing the fog-generating material, by gas-conversion of the reagent, this drop in pressure is not an issue for the fog-generating device as described herein. With reference to FIGS. 1 and 2, the stacked plates are welded to one another around a thick-walled central tube (19) feeding the fog-generating liquid to the top of the stack. The pile of stacked plates is covered and connected to a base element (22) comprising the in- and outlet, by means of a lid element (21) with a central axle (20) at the centre of said feeding tube (19). Said axle not only increases the heat capacity, but also enhances heat transfer to the fog-generating material traveling upwards in the thus narrowed central tube (19).

With reference to European Patent EP 2 259 004 B1, the latent heat of fusion accumulator as used herein, is essentially a latent heat storage medium, wherein latent heat is defined as the amount of energy in the form of heat released or absorbed by a substance during a change of phase state respectively from liquid to solid, or solid to liquid. By implementing such latent heat of fusion accumulator in the fog generator, the fog ejection capacity may be increased significantly due to stored latent heat which is an extra source of fog generation energy during the exothermic phase change from liquid to solid.

The liquid-solid phase change material may comprise any material that may be used as a latent energy source by exothermically changing its phase from liquid into solid. In practice it may be selected based on: the optimal vaporization temperature of the fog fluid used the optimal ratio between the volume of phase change material and its fusion energy, such that as much as possible energy is stored in as less as possible volume of molten phase change material the thermal conductivity of the molten or solidified phase change material the corrosive and diffusion properties of the phase change material. Preferably, the liquid-solid phase change material may comprise at least one of the group of non-ferro metals, or of the group of nitrate salts, chloride salts and the like, or a mixture thereof. Even more preferably, the non-ferro metal may comprise zinc or zinc alloys, such as zamak. Zinc or zinc alloys meet the above selection criteria in terms of fusion temperature, thermal conductivity, ratio between stored fusion energy and volume, less reactive and less diffusive in the heat exchanger metal body. Additionally, it does not contain lead and may be considered as non-toxic. As will be evident to the skilled man, the heat exchanger comprises a heating element, preferably an electrical heating element, with accompanying temperature control (thermostatic PID), over-temperature protection and thermal insulation.

In another particular embodiment, the fog-generating device of the present invention further comprises means to entrain ambient air in the fog. In a further embodiment, said means to entrain air in the fog comprise a steam ejector. Fog that is expelled by the fog-generating device of the present invention flows through the steam ejector and entrains ambient air. Because the kinetic energy of the fog that exits the heat exchanger can be much higher than in prior art devices, the steam ejector can be constructed so that large amounts of ambient air are entrained in the fog. It has been found that this leads to a faster cooling of the fog that is expelled from the device and results in a better distribution of the fog in the surroundings of the device.

In yet another particular embodiment, gas purges the heat exchanger after the fog-generated material has been converted to fog. It has been found that purging the heat exchanger prevents negative effects of residues of fog-generating material that remain in het heat exchanger. These residues that remain in the hot heat exchanger may lead to bad smells, corrosion and dry matter build-up. In particular, sufficient reagent is used, so that more gas is generated than is strictly necessary for driving the fog-generating material from the reservoir to the heat exchanger. After the fog-generating material has been driven through the heat exchanger, generated gas keeps flowing through the heat-exchanger, thereby purging it. If the generated gas is used to power a pump that drives the fog-generating material to the heat exchanger, it may continue powering said pump, thereby pumping air through the heat exchanger and purging it.

In another particular embodiment, the fog-generating device of the present invention or the removable housing therefore comprises depressurizing means (18). Depressurizing means allow the escape of gas from the device so that the pressure inside the device is reduced and becomes closer to atmospheric pressure. Depressurizing means allow for the safer handling and recycling of the device and especially removable housings of the present invention. Depressurizing means may be constructed so that they will be used automatically and/or they may be constructed to be initiated manually. Depressurizing means can e.g. be a valve that is to be switched manually. In a particular embodiment, depressurizing means are constructed in such a manner that the pressure in the device is released automatically during or after the fog-generating process. In a particular embodiment, the fog-generating device of the present invention is constructed to activate said depressurizing means after a predetermined amount of fog-generating liquid has been expelled. In another particular embodiment, the pressure is released upon removal of the removable housing from the fog-generating device. For example, the depressurizing means comprise a valve that is automatically opened when the removable housing is disconnected from the fog-generating device. In a preferred embodiment, the depressurizing means are constructed in such a manner that pressure in the device is released when substantially all fog-generating liquid has been expelled from the reservoir. Besides being beneficial to the safety when handling and recycling, the depressurizing means can be constructed in such a manner that gas that is released from the device during such depressurizing can be used for purging the heat exchanger. In this embodiment, after substantially all the fog-generating liquid has been expelled from the reservoir, the generated gas can be expelled from the housing to the heat exchanger, thereby purging the heat exchanger. For example, with reference to FIG. 8, the fog-generating device or a removable housing therefore may comprise a movable wall gas to expel fluid from the reservoir. The reservoir contains depressurizing means (present as a groove in the wall of the reservoir) which are located in close proximity to the exit of the reservoir. When substantially all of the fluid has been expelled from the reservoir, the movable wall is located at the groove (18). Gas generated from the reagent is present at a high pressure and can escape from the housing through the groove. Thereby, the pressure inside the housing is reduced towards the atmospheric pressure.

Escaped gas enters the liquid connection means towards the heat exchanger, thereby purging the heat exchanger, providing the benefits described above. Another example is presented in FIG. 5. Herein, the movable wall (8) will push the fog-generating material out of the reservoir upon gas generation from the reagent. Once the movable wall contacts the end of the reservoir (and the depressurizing means (18) are located in close proximity to the exit of the reservoir), the pressure inside the emptied reservoir will rupture the pressure-sensitive depressurizing means (18) or a certain position of the movable wall invokes a mechanical puncture of the movable wall as depressurizing means. From that moment, gas from inside the reservoir can escape through the depressurizing means towards the heat exchanger, thereby purging said heat exchanger. In a further embodiment the present invention provides the use such reservoir or removable housing comprising depressurizing means in a fog-generating device, in particular in a fog-generating device comprising a heat exchanger.

The inventors found that, due to the limited volume of reagent that is needed to generate the gas for the complete process of fog generation, a removable housing for the fog-generating device of the present invention can easily be build which comprises a reagent and a reservoir containing the fog-generating liquid. Such a removable housing comprising a reagent can be constructed to be very small. As the use of a pyrotechnic reagent obviates the need for a pump or a large compressed vessel in the fog-generating device, the removable housings of the present invention allow for the construction of much smaller fog-generating devices compared to the prior art. Furthermore, in contrasted to several prior art fog-generating devices, the devices of the present invention comprising a removable housing, can easily be serviced so that they can be used again. Therefore, the invention provides a removable housing for a fog-generating device comprising a reagent and a reservoir containing a fog-generating material, wherein said removable housing further comprises means to allow transmission of an ignition signal or of ignition energy from said fog-generating device to said reagent. The skilled person is well aware on how to select means to allow transmission of an ignition signal/impact conveyer or energy from said fog-generating device to said reagent, depending on the reagent that is used and the structural requirements of the removable housing. In a particular embodiment, the removable housing comprises at least part of the ignition means and connection means to transmit a signal or ignition energy from the fog-generating device to said at least part of the ignition means. For example, the removable housing may comprise an ignition wire that contacts the reagent and ignites when an electrical current runs through it. Electrical connection means will connect said ignition wire to the electrical power system of the fog-generating device. In case of activation, the fog-generating device will transmit an electrical current or signal to the ignition wire or ignition means in the removable housing and start the gas generation. Evidently, other possibilities exist to transmit the ignition signal from the fog-generating device to the removable housing, such as means that allow transmission of an shock produced by an element of the fog-generating device to the reagent, means that allow transmission of laser energy from a laser source in the fog-generating device to the reagent in the removable housing, etcetera.

Furthermore, the removable housing of the present invention may comprise liquid connection means to allow a liquid connection between the reservoir in the removable housing containing fog-generating liquid to the inlet of the heat exchanger. The liquid connecting means may take a variety of forms, to suit the present applications. For example, it may comprise a conduit in the form of a tube or a hollow needle, an aperture, or a slit in a membrane. The conduit may be arranged such that no appreciable flow can occur under gravity alone. In this way, controlled delivery of the fog-generating liquid can be achieved. The conduit may, for example, comprise a small aperture, or a tubular portion with a small bore, such that surface tension of the liquid inhibits flow. Alternatively, or additionally, the conduit may comprise two-way valve means, arranged to prevent fluid flow unless the pressure difference across it exceeds a certain value. In particular, the liquid connection means ensure a liquid-tight connection through which the fog generating liquid can run, from the removable housing to the heat exchanger.

Figure 8:
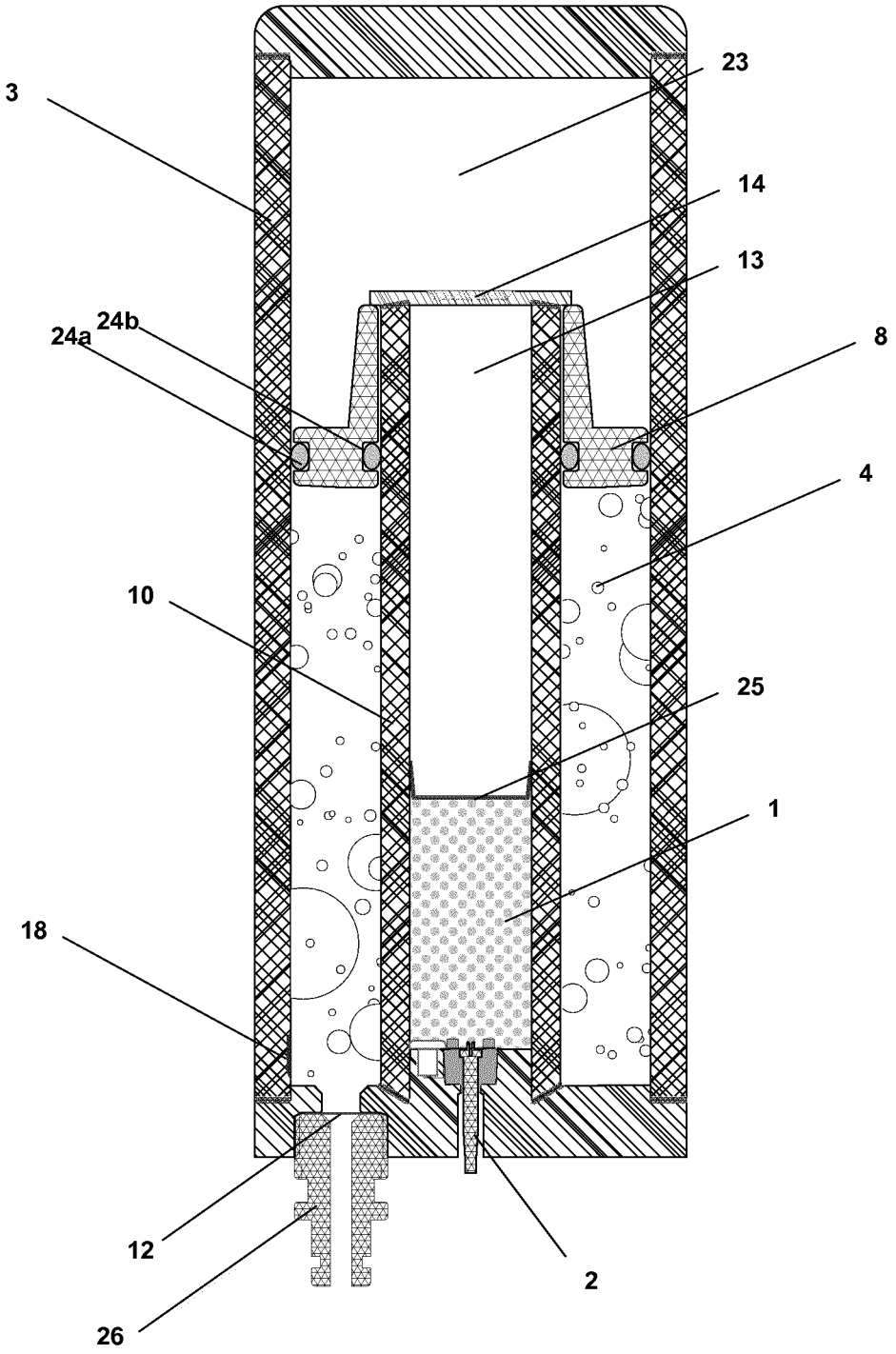
FIG. 8: Cross sectional view of a removable housing for use in a fog-generating device according to the present invention.

The removable housing of the present invention allows the housing to be removed from and reconnected to the remainder of the fog-generating device that comprises the heat exchanger. Therefore, in a particular embodiment, the removable housing of the present invention does not comprise a heat exchanger. In another particular embodiment, the removable housing of the present invention comprises fixation means (26), which connect the removable housing to the remainder of the fog-generating device. During functioning, high pressures may be generated from the reagent combustion. Such fixation means allow the removable housing to remain connected to the remainder of the device, despite these high pressures. In a preferred embodiment, the fixation means are present in close proximity to exit where through the fog-generating material is expelled from the reservoir. In a further embodiment, the fixation means are located close to the liquid connection means. In an even further embodiment, the fixation means are part of the liquid connection means, for example as shown in FIG. 8.

After a fog-generating device has been used, only the insertion of a small removable housing of the invention is needed to get a functional fog-generating device. Whereas in prior art devices, a whole new fog-generating device needed to be transported, thanks to the present invention only small cartridges need to be transported. Furthermore, a user can easily store spare removable housings in case a replacement is needed. The fool-proof replacement allowed by the removable housings of the present invention allows a non-skilled user to replace the removable housing himself. In prior art devices, servicing an emptied fog-generating device would require replacement of the whole device, necessitating disconnecting the device from the security system, something that can only be done by a skilled technician.

Exemplary embodiments of such removable housings, incorporating different embodiments of the present invention, are provided in FIGS. 3 to 7. Each of said figures provide cross sectional views of the removable housings for use in a fog-generating apparatus according to the present invention.

Figure 3:
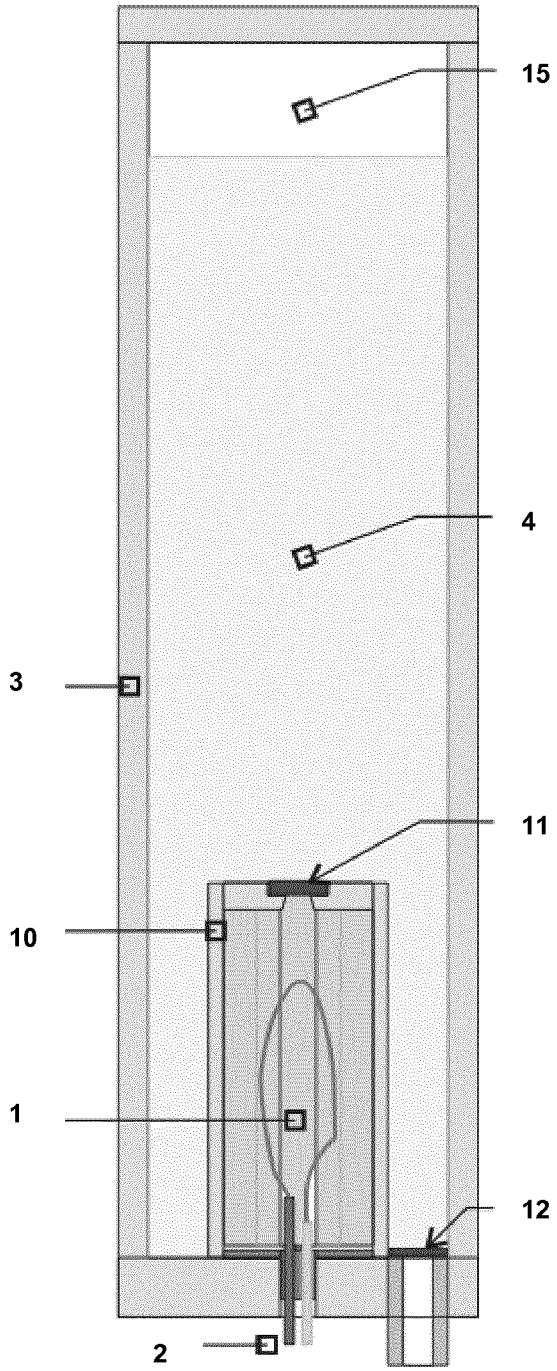
FIG. 3: Cross sectional view of a reservoir comprising fog-generating material, a reagent and ignition means, for use in the fog-generating device according to the present invention.

FIG. 3, represent said embodiment wherein the reagent (1) is present in a housing (10) within the reservoir (3) containing the fog-generating material (in the exemplified embodiment being a fog-generating fluid). Ignition (2) of the reagent results in the conversion and formation of gas, with a built up of pressure within said housing. At the top, said housing comprises a pressure-sensitive seal (11) (in the present instance a bursting disc) that opens at a given pressure (in the present instance a pressure difference of up to about 180 Bar). Upon opening, gas expels into the fog generating material with an accompanying built up of pressure in the reservoir comprising the fog generating material. Through closing means (12) (such as a valve or further pressure-sensitive seals) release of the fog-generating material now under pressure, can be controlled. In a particular embodiment this closing means consists of a pressure-sensitive seal, thus excluding the presence of moving elements in controlling the release from the fog-generating fluid from its reservoir. Upon opening of said closing means, the gas generated from the reagent will drive the fog-generating material out of the reservoir to the heat exchanger to convert the fog-generating fluid in a fog leaving the fog-generating device.

Figure 4:
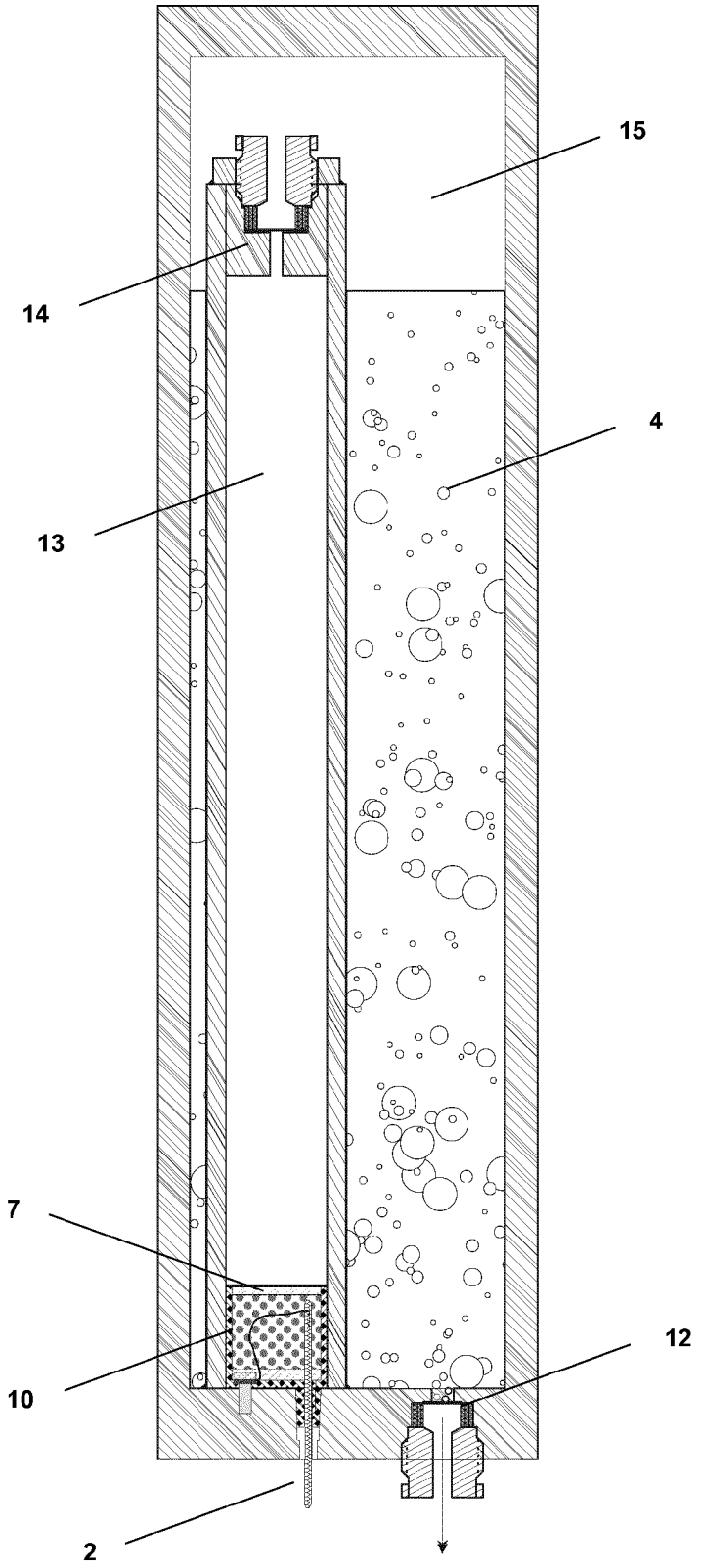
FIG. 4: Cross sectional view of a removable housing for use in a fog-generating device according to the present invention.

In FIG. 4, the removable housing further comprises a combustion chamber (13), typically surrounding the housing comprising the reagent. As already mentioned hereinbefore, the presence of such an initially sealed combustion chamber improves the efficiency of reagent combustion. Different from the embodiment shown in FIG. 3, the presence of the initially sealed combustion chamber will prevent an eventual interaction between the fog-generating material and the reagent. The latter could lead to undesirable and potentially harmful reaction products, and should preferably be avoided. In the present instance ignition of the reagent results in the conversion and generation of a gas that is initially confined in the combustion chamber with a built up in pressure that will eventually result in the opening of said chamber through a pressure-sensitive seal (14) (in the present instance a bursting disc). Further release of the gas into the reservoir and eventual release of the fog-generating material from the reservoir is analogous to the embodiment of FIG. 3 above.

It is also an object of the present invention to provide the use of the removable housing according to the invention and in its different embodiments (supra) described herein, in a fog-generating device, in particular in a fog-generating device comprising a heat exchanger.

Figure 6:
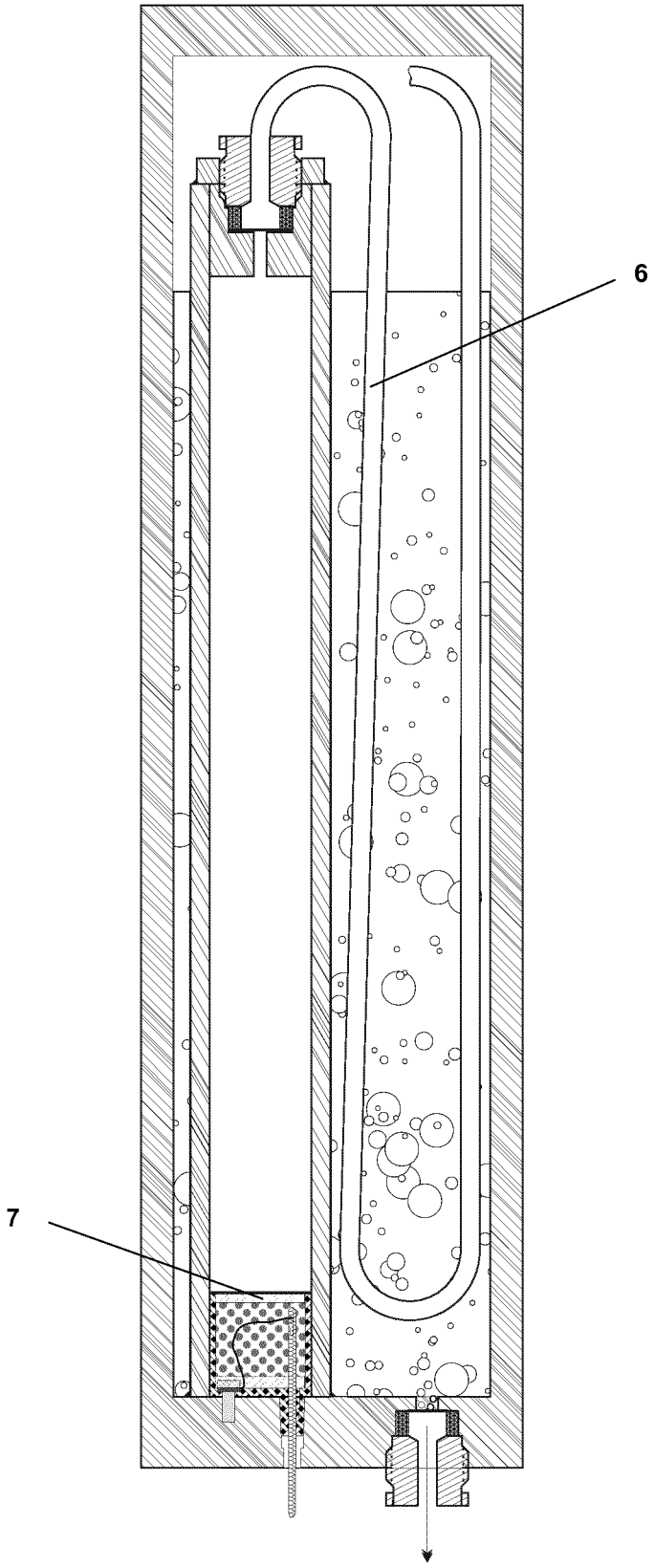
FIG. 6: Cross sectional view of a removable housing for use in a fog-generating device according to the present invention.
Figure 7:
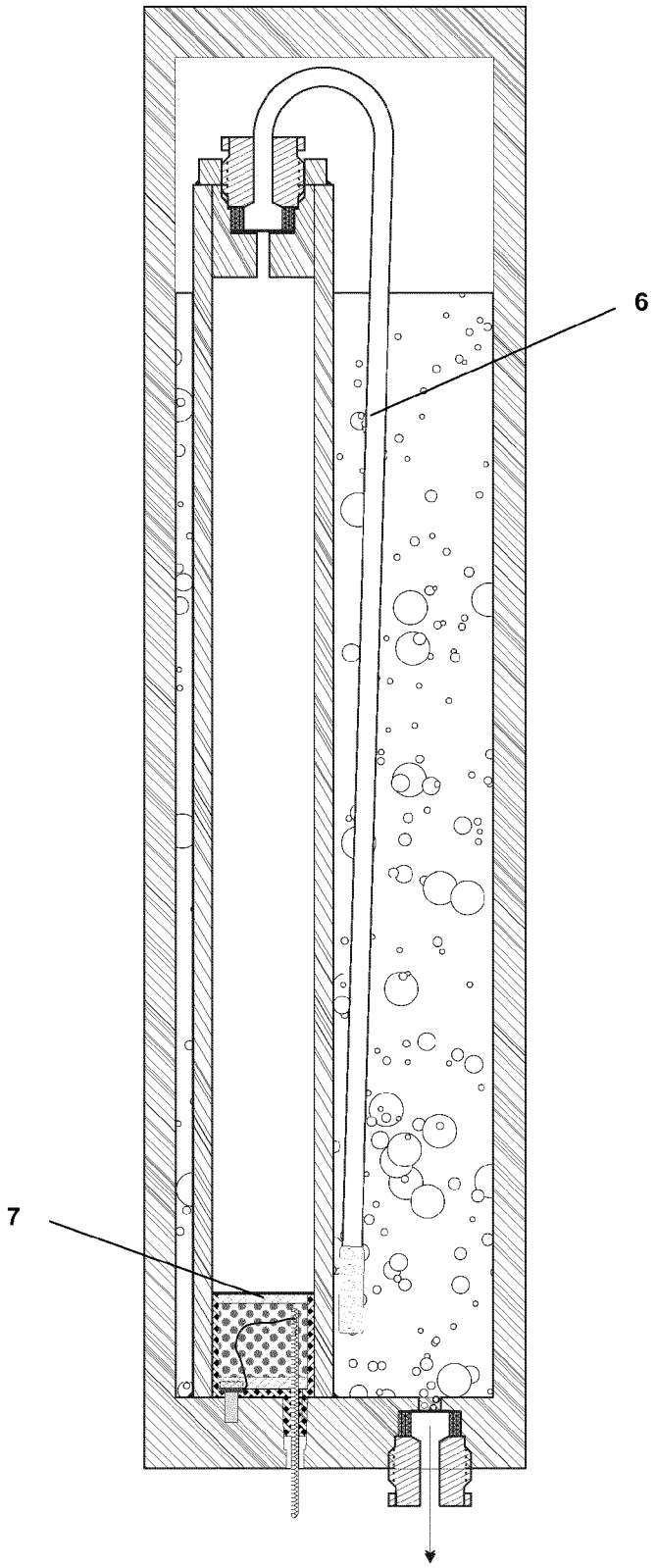
FIG. 7: Cross sectional view of a removable housing for use in a fog-generating device according to the present invention.

As already mentioned herein before, in order to prevent a potentially negative effect of hot gas on components of the fog-generating material (e.g. glycol), in a particular embodiment, the fog-generating device of the present invention further comprises cooling means (6) to cool said gas before it contacts said fog-generating material. FIGS. 6 and 7 provide examples of such cooling means. In FIG. 6 a cooling channel passes through the fog-generating material, with release of the cooled gas into the topping gas (15) typically found in a reservoir with fog generating fluid. To preserve the fog-generating material, such topping gas consists of inert gasses like nitrogen or argon. In the alternative embodiment shown in FIG. 7, the generated gas is released into the fog generating material instead.

In several foregoing exemplified embodiments the generated gas will ultimately get in contact with the fog-generating material. In prior art fog-generating devices, it was common knowledge that as much as possible gas should be mixed with the fog-generating fluid prior to entering the heat exchanger. For example, WO2003001140 describes in detail the benefits of at least partially dissolving in the fog-generating fluid the propellant gas that is used to drive the fluid from the reservoir to the heat exchanger. When gas is mixed in the fog-generating fluid, it expands (explodes as it where) in the heat exchanger, thereby improving the outflow of the fog. Surprisingly, the inventors have found that, if a pyrotechnic device is used to generate gas that drives the fluid to the heat exchanger, the outflow of fog actually improves even further by not solubilizing gas in the fog-generating fluid. In that regard, the embodiments wherein the device of the present invention further comprises a movable wall is especially preferred.

Figure 5:
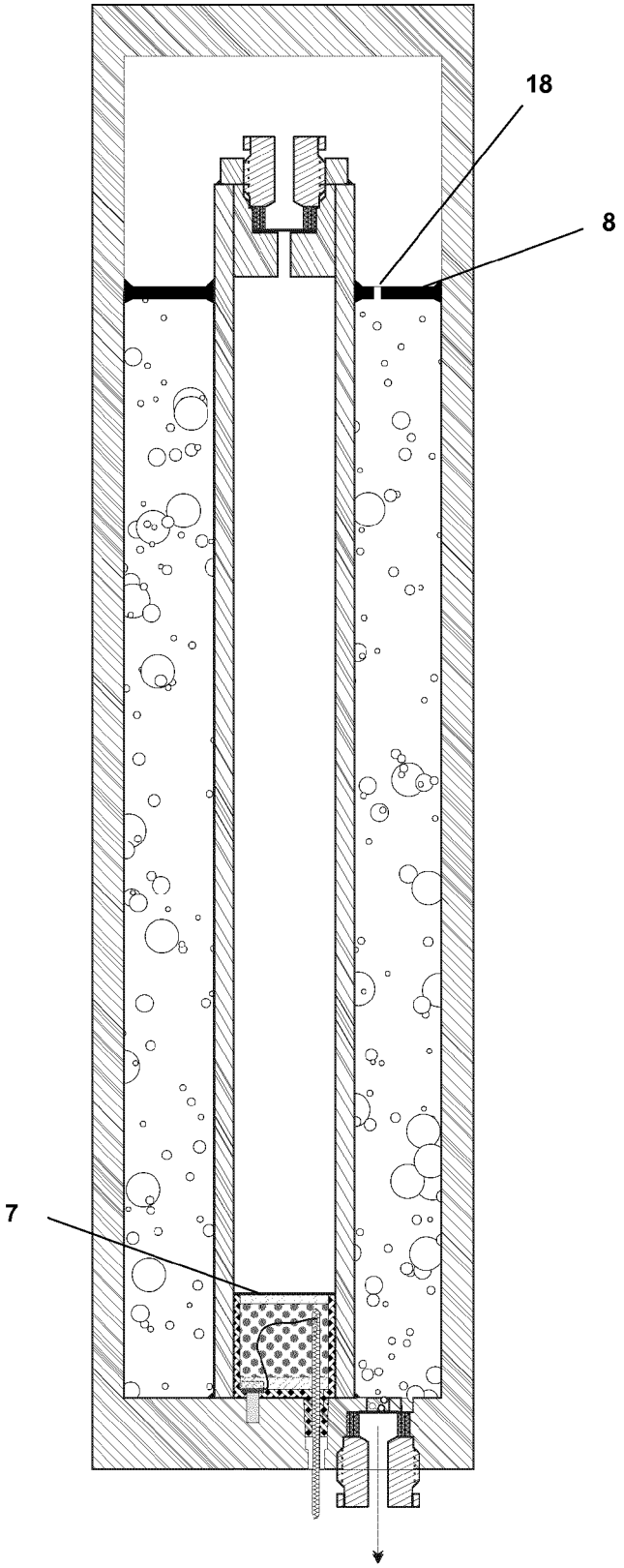
FIG. 5: Cross sectional view of a removable housing for use in a fog-generating device according to the present invention.

Therefore, in a particular embodiment, the fog-generating device of the present invention further comprises a movable wall (8). The presence of the movable wall allows the device to be tilted in any orientation without affecting its efficiency. The movable wall is in particular situated between the fog-generating material and the gas generated from the reagent, such as shown in FIG. 5 and FIG. 8, surrounding the combustion chamber in a liquid-tight manner. In other words, said wall operates as a plunger in a shaft (in the present instance the reservoir comprising the fog-generating fluid and the outer perimeter of the combustion chamber) and drives the fog-generating material from the reservoir towards the heat exchanger. Consequently, in a particular embodiment, said movable wall further comprises sealing means to prevent fluid leakage between said plunger and the shaft. Said sealing means can be any suitable sealant, including a sealing gel, one or more sealing rings or a sealing plunger head. Such sealing rings and sealing plunger head can be made from any suitable material known in the art, such as for example, but not limited to plastic, metal or elastomer. Due to the movable wall, the fog-generator and/or removable housing can be held in any orientation without fluid contacting the reagent and ignition. E.g. when the device or removable housing as represented in the figures would be inverted compared to the showing in the figures, the fog-generating device will work as efficiently. The separation means allow the fog-generating liquid to be always in contact with the liquid connection means towards the heat exchanger, even when tilted. Thanks to the construction of the device or removable housing in this manner, the fog-generating device can also be oriented in any direction. This allows for a much larger degree of freedom when positioning the fog-generating device, which is often crucial to direct generated fog towards valuables or the expected entry of intruders. As an added benefit, the movable wall prevents direct contact and substantial heat transfer between the fog-generating material and the gas generated from the reagent.

In a further particular embodiment, the device of the present invention further comprises reagent holding means (25). Reagent holding means prevent that reagent is distributed freely in the remainder of the housing, and in particular in the combustion chamber before ignition. Beneficially, they allow the reagent to be pressed slightly, so that there is a good contact between all the reagent material to ensure that the initiated chain reaction of the reagent is completed over the full mass of the reagent. This has been found to increase combustion efficiency, as more reagent is used in the reaction. The reagent holding means may be the same or different from the above-described separation means (7). In a preferred embodiment, the reagent holding means are different from the separation means. In a further embodiment, the device of the present invention comprises separation means as well as reagent holding means. This allows for holding the reagent in close proximity to the ignition means, as well as for an empty space in the compartment holding the reagent (between the holding means and the separation means). Such an empty space (combustion chamber) has been found to further increase the efficiency of the combustion of the reagent. In another particularly preferred embodiment, the fog-generating device of the present invention comprises reagent holding means and a movable wall. This combination allows for an efficient device which can be oriented in any direction, as the movable wall keeps the fog-generating material into contact with the fluid connection means towards the heat exchanger and the reagent holding means keep the reagent in close proximity to the ignition means.

In a preferred embodiment, the device or removable housing of the present invention comprises at least four compartments:

- the first compartment contains the reagent (1), the compartment occupies part of the reagent-containing container (10). This compartment does not need to be enclosed, but optionally reagent holding means (25) are present. Reagent holding means prevent that reagent is distributed freely in the remainder of the housing, and in particular in the combustion chamber (13) before ignition. Beneficially, they allow the reagent to be pressed slightly, so that there is a good contact between all the reagent material to ensure that the initiated chain reaction of the reagent is completed over the full mass of the reagent. This has been found to increase combustion efficiency, as more reagent is used in the reaction.
- the second compartment is the combustion chamber (13) which is a free space in or around the initially sealed container holding the reagent. The combustion chamber also increases efficiency and initial pressure build-up.
- the third compartment is an expansion space (23) wherein generated gas can expand and start moving the separation means. The expansion space allows the reagent to be combusted completely and thus also aids in the efficiency of combustion.
- the fourth compartment contains the fog-generating liquid. This compartment is enclosed by at least part of the reservoir walls and the separation means.

It has been found that substantially all the reagent in the housing of the present invention has been combusted. Therefore, after the reaction has taken place, the remainder of the housing is clean and does not contain remaining reagent that could be ignited. Thus, the removable housing can be recycled or disposed of safely. Evidently, the use of the foregoing compartments or of the removable housing comprising said compartments in a fog-generating device is also an object of the present invention, in particular their use in a fog-generating device comprising a heat exchanger.

As explained herein, in a particular embodiment excess gas is generated and said excess gas can be used, either directly or indirectly, to purge the heat exchanger and remove non-ejected vapour out of the heat exchanger into the ambient air. To enable said purging in case of a movable wall (8) between the fog-generating material and the gas generated from the reagent, said movable wall optionally comprises depressurizing means (18). As for example shown in FIG. 5, said further pressure sensitive closing means could consist of a burst plate or break point in the movable wall. In another embodiment, depressurizing means (18) may be present as a groove in the reservoir, such as shown in FIG. 7. When the movable wall (8) has expelled substantially all the fog-generating fluid from the reservoir, it is located at the groove, thereby allowing excess gas to escape the reservoir and enter the lining towards the heat exchanger, thereby purging said heat exchanger.

The construction of a removable housing comprising reagent and fog-generating material allows for replacement of said consumables in a single action. Thus, the use of such a removable housing obviates the need to replace the reagent and the fog-generating material separately. Evidently from the above, the fog-generating device of the present invention may comprise multiple removable housings, e.g. for redundancy or for additional fog generation.

The present invention also provides the use of a fog-generating machine or removable housing as described herein for generating fog. In addition, the present invention provides the use of a fog-generating machine or removable housing as described herein for protecting against burglars and intruders. In addition, the present invention provides a method for generating fog, said method comprising:

a) generating gas by igniting a reagent;
b) using said gas to drive a fog-generating material from a reservoir to a heat exchanger; and
c) generating fog by heating said fog-generating material in said heat exchanger.

In one embodiment the reservoir used in the aforementioned method comprises separation means as described herein, in particular a movable wall separating the fog-generating material from the reagent as described herein. It is accordingly an object of the present invention to provide a method for generating fog, said method comprising:

a) providing a reservoir comprising separation means (in particular a movable wall) and a fog-generating liquid, wherein said reservoir is connected to a heat exchanger;
b) generating gas by igniting a reagent;
c) use the gas generated by said reagent to drive said separation means (in particular said movable wall), thereby expelling the fog-generating material from the reservoir to the heat exchanger; and
d) generating fog by heating said fog-generating material in said heat exchanger.

In principle, in the aforementioned method any force capable to drive the separation means, can be used to expel the fog-generating material from the reservoir into the heat exchanger. In said embodiment the invention provides a method for generating fog, said method comprising;

a) providing a reservoir comprising separation means (in particular a movable wall) and a fog-generating liquid, wherein said reservoir is connected to a heat exchanger;
b) using a force to drive said movable wall, thereby expelling the fog-generating liquid from the reservoir to the heat exchanger; and
c) generating fog by heating said fog-generating material in said heat exchanger.

In a preferred embodiment the force to drive the separation means is a gas propellant, such as for example selected from a compressed gas a liquefied gas, a gas generated by igniting a reagent as described herein. In said embodiment the invention provides a method for generating fog, said method comprising;

a) providing a reservoir comprising separation means (in particular a movable wall) and a fog-generating liquid, wherein said reservoir is connected to a heat exchanger;
b) using a gas to drive said movable wall, thereby expelling the fog-generating liquid from the reservoir to the heat exchanger; and
c) generating fog by heating said fog-generating material in said heat exchanger.

The invention claimed is:

1. A fog-generating device comprising a reservoir comprising a movable wall and a fog-generating material, a heat exchanger; and means for driving said movable wall to expel the fog-generating material from the reservoir to the heat exchanger.

2. The fog-generating device of claim 1, wherein said means for driving said movable wall comprise a reagent and ignition means, wherein gas generated by ignition of the reagent drives said movable wall to expel said fog-generating material from said reservoir to said heat exchanger.

3. The fog-generating device according to claim 2, wherein said reagent comprises a fuel and an oxidizer.

4. The fog-generating device according to claim 2, wherein said reagent is a deflagrating material.

5. The fog-generating device according to claim 2, wherein said gas enters said reservoir to drive said movable wall to expel fog-generating material from said reservoir to said heat exchanger.

6. The fog-generating device according to claim 2, further comprising reagent holding means for holding the reagent into close proximity to the ignition means.

7. The fog-generating device according to claim 2, further comprising depressurizing means.

8. The fog-generating device according to claim 7, which is constructed to activate said depressurizing means after a predetermined amount of fog-generating liquid has been expelled from said reservoir.

9. The fog-generating device according to claim 7, wherein said depressurizing means are located in a wall of said reservoir.

10. The fog-generating device according to claim 7, which is constructed to expel gas through said depressurizing means to the heat exchanger, thereby purging the heat exchanger.

11. The fog-generating device according to claim 1, wherein said fog-generating material is a polyol-containing liquid.

12. The fog-generating device of claim 1, wherein said means for driving said movable wall comprise a gas.

13. The fog-generating device of claim 12, wherein said means for driving said movable wall comprise a liquefied propellant gas or a compressed propellant gas.

14. The fog-generating device according to claim 1, wherein said reservoir containing the fog-generating material and the movable wall is comprised in a removable housing that can be removed from the remainder of the fog-generating device that comprises the heat exchanger.

15. A removable housing for the fog-generating device of claim 1, the removable housing comprising the reservoir comprising: (a) the fog-generating material, (b) the movable wall constructed to expel fog-generating material from the reservoir, (c) a compressed propellant gas or a liquefied propellant gas for driving said movable wall, and (d) depressurizing means.

16. The removable housing of claim 15, wherein the fog-generating material is a polyol-containing liquid.

17. A removable housing for the fog-generating device of claim 1, the removable housing comprising the reservoir comprising: (a) the fog-generating material being a polyol-containing liquid, and (b) the movable wall constructed to expel the fog-generating material from the reservoir.

18. A removable housing for the fog-generating device of claim 1, the removable housing comprising:

(i) the reservoir comprising
  (a) the fog-generating material, and
  (b) the movable wall constructed to expel the fog-generating material from the reservoir; and
(ii) a liquid-tight connection specifically adapted to connect an exit of the reservoir of the removable housing to an inlet of the heat exchanger in the fog-generating device.

19. A method for generating fog, said method comprising:

a) providing a reservoir comprising a movable wall and a fog-generating liquid, wherein said reservoir is connected to a heat exchanger;
b) using the force of gas to drive said movable wall, thereby expelling the fog-generating liquid from the reservoir to the heat exchanger; and
c) generating fog by heating said fog-generating material in said heat exchanger.

20. The method for generating fog according to claim 19, wherein said gas is generated by igniting a reagent.

* * * * *